US010211604B2

(12) United States Patent
Tokumaru et al.

(10) Patent No.: US 10,211,604 B2
(45) Date of Patent: Feb. 19, 2019

(54) SPARK PLUG

(71) Applicant: NGK SPARK PLUG CO., LTD., Nagoya-shi, Aichi (JP)

(72) Inventors: Masaki Tokumaru, Iwakura (JP); Yasushi Sakakura, Ichinomiya (JP)

(73) Assignee: NGK SPARK PLUG CO., LTD., Nagoya-shi (JP)

( * ) Notice: Subject to any disclaimer, the term of this patent is extended or adjusted under 35 U.S.C. 154(b) by 0 days.

(21) Appl. No.: 16/031,463

(22) Filed: Jul. 10, 2018

(65) Prior Publication Data

US 2019/0020180 A1 Jan. 17, 2019

(30) Foreign Application Priority Data

Jul. 13, 2017 (JP) ..... 2017-136752

(51) Int. Cl.
*H01T 13/36* (2006.01)
*H01T 13/34* (2006.01)

(52) U.S. Cl.
CPC ..... *H01T 13/34* (2013.01); *H01T 13/36* (2013.01)

(58) Field of Classification Search
CPC ..... H01T 13/34; H01T 13/36
See application file for complete search history.

(56) References Cited

U.S. PATENT DOCUMENTS 5,873,338 A * 2/1999 Matsubara ..... H01T 13/08 123/169 EL
2008/0079344 A1* 4/2008 Zalud ..... H01T 13/36 313/143
2013/0134857 A1* 5/2013 Shimamura ..... H01T 13/16 313/135
2017/0256918 A1* 9/2017 Bundschuh ..... H01T 13/38
2018/0123323 A1 5/2018 Kobayashi et al.

FOREIGN PATENT DOCUMENTS

WO WO 2016/174816 A1 11/2016

* cited by examiner

*Primary Examiner* — Donald L Raleigh
(74) *Attorney, Agent, or Firm* — Kusner and Jaffe

(57) ABSTRACT

A spark plug having an insulator that includes a fitted portion in contact with a rear end surface of a ledge portion of a metal shell. The insulator has a recessed portion recessed radially inward. The recessed portion is formed in an outer circumferential surface which is located on the rear side of the insulator relative to the fitted portion and which is disposed in the metal shell. The area of an outer circumferential surface of the insulator, from a front end of the recessed portion to a front end of the fitted portion, is larger than or equal to the area of a surface of the insulator which is exposed to combustion gas.

4 Claims, 3 Drawing Sheets

SPARK PLUG

RELATED APPLICATIONS

This application claims the benefit of Japanese Patent Application No. 2017-136752, filed Jul. 13, 2017, the entire content of which is incorporated herein by reference.

FIELD OF THE INVENTION

The present invention relates to a spark plug, and particularly relates to a spark plug having excellent heat dissipation property.

BACKGROUND OF THE INVENTION

As a spark plug mounted to an internal combustion engine, a spark plug is known that includes a tubular insulator to which a center electrode is fixed, and a tubular metal shell disposed on the outer circumference of the insulator, and that causes discharge in an inter-electrode spark gap. In this type of spark plug, charges stored by parasitic capacitance between the center electrode and the metal shell flow into the spark gap at the time of discharge, and electrode erosion may be thus caused. In order to reduce the parasitic capacitance and suppress the electrode erosion, International Publication No. 2016/174816 discloses a technique in which a recessed portion (an air layer having a dielectric constant lower than the dielectric constant of an insulator) is provided in the outer circumferential surface of the insulator.

However, in the above-described conventional technique, the recessed portion (air layer) formed in the outer circumferential surface of the insulator suppresses heat transfer from the insulator to a metal shell, and thus, the heat dissipation property is reduced accordingly. As a result, there is a risk that the insulator is overheated and pre-ignition comes to easily occur.

The present invention has been conceived to address the above-described problem. An advantage of the present invention is a spark plug that enables improvement in heat dissipation property.

SUMMARY OF THE INVENTION

In accordance with a first aspect of the present invention, there is provided a spark plug that includes: an insulator in which an axial hole is formed so as to extend in a direction of an axis from a front side to a rear side; a center electrode at least partially inserted in a front side of the axial hole; a metal terminal at least partially inserted in a rear side of the axial hole; a connection portion connecting the metal terminal and the center electrode to each other in the axial hole; and a tubular metal shell disposed on an outer circumference of the insulator. The metal shell includes a ledge portion which projects from an inner circumference side thereof, and the insulator includes a fitted portion in contact with a rear end surface of the ledge portion, and has a recessed portion recessed radially inward, the recessed portion being formed in an outer circumferential surface which is located on the rear side of the insulator relative to the fitted portion and which is disposed in the metal shell. In the insulator, an area of an outer circumferential surface from a front end of the recessed portion to a front end of the fitted portion is larger than or equal to an area of a surface which is exposed to combustion gas.

In the spark plug according to the first aspect, parasitic capacitance between the center electrode and the metal shell can be reduced owing to the recessed portion formed in the outer circumferential surface of the insulator. The surface, of the insulator, which is exposed to combustion gas receives heat primarily from an internal combustion engine. The outer circumferential surface, of the insulator, from the front end of the recessed portion to the front end of the fitted portion contributes to heat dissipation from the insulator to the metal shell. Since the area of the outer circumferential surface, of the insulator, from the front end of the recessed portion to the front end of the fitted portion is larger than or equal to the area of the surface, of the insulator, which is exposed to combustion gas, heat dissipation from the insulator to the metal shell can be facilitated. Therefore, the heat dissipation property can be improved.

In accordance with a second aspect of the present invention, there is a provided a spark plug as described above, wherein the connection portion includes: a first conductor in contact with the center electrode; a resistor in contact with the first conductor; and a second conductor in contact with the resistor and the metal terminal. The insulator has a step portion which is in the axial hole and to which the center electrode is fitted from the front side. A front end of a section, of the step portion, which is in contact with the center electrode is positioned rearward of a front end of a bottom portion on a radially inner side of the recessed portion, and thus, thermal stress received from the internal combustion engine can be made less likely to be transmitted to the first conductor and the resistor. Therefore, in addition to the effect as in the first aspect, degradation of the first conductor and the resistor can be suppressed.

In accordance with a third aspect of the present invention, there is provided a spark plug as described above, wherein a filler is filled between the metal shell and at least a part of a section, of the outer circumferential surface of the insulator, from the front end of the fitted portion to the front end of the recessed portion. Heat dissipation between the insulator and the metal shell can be facilitated owing to the filler, and thus, in addition to the effect as in the first or second aspect, the heat dissipation property can be further improved.

DETAILED DESCRIPTION OF THE INVENTION

Figure 1:
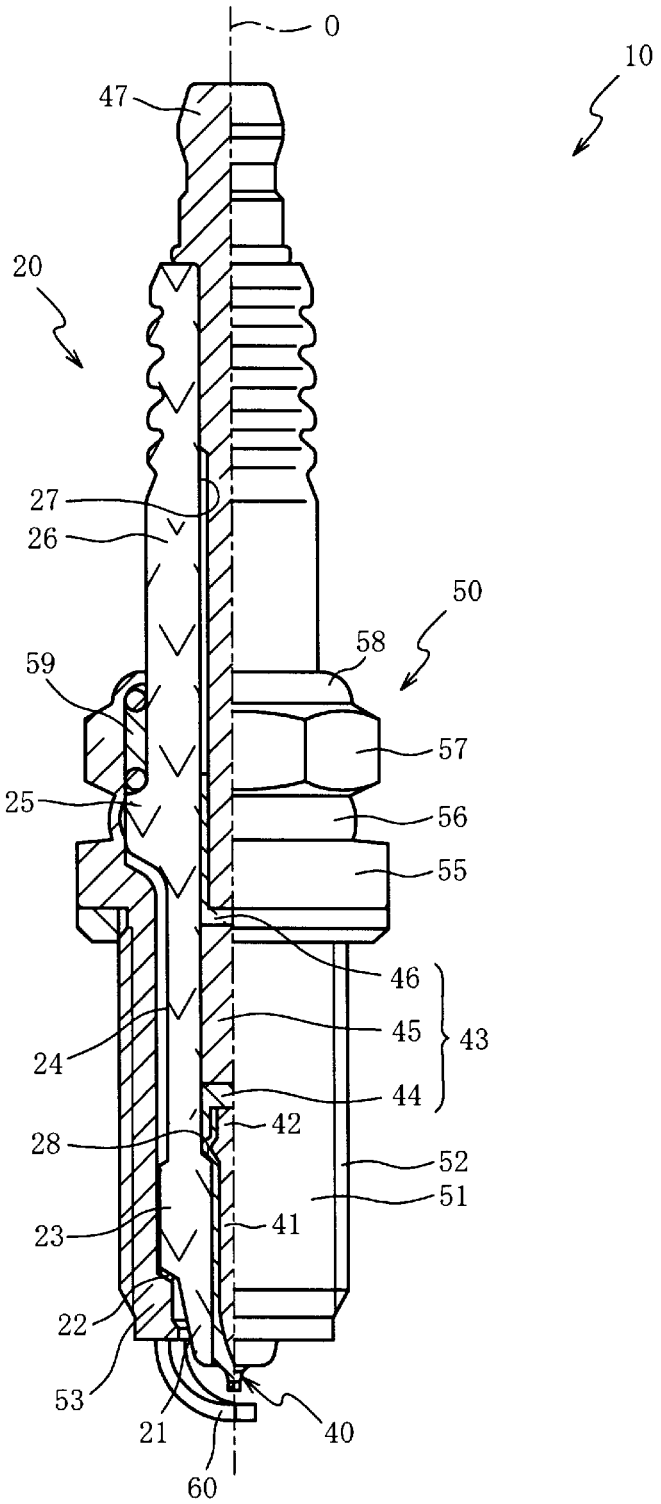
FIG. 1 is a half-sectional view of a spark plug according to a first embodiment of the present invention.

Hereinafter, preferred embodiments of the present invention will be described with reference to the accompanying drawings. FIG. 1 is a half-sectional view of a spark plug 10 according to a first embodiment of the present invention, with an axis O as a boundary. In FIG. 1, the lower side on the surface of the drawing sheet is referred to as a front side of the spark plug 10, and the upper side on the surface of the drawing sheet is referred to as a rear side of the spark plug 10 (the same applies to FIG. 2). As shown in FIG. 1, the spark plug 10 includes an insulator 20, a center electrode 40, a metal terminal 47, and a metal shell 50.

The insulator 20 is a substantially cylindrical member formed of alumina or the like having excellent mechanical property and insulation property at high temperature. The insulator 20 is formed by a front end portion 21, a small-diameter portion 23, a large-diameter portion 25, and a rear end portion 26 being contiguous to each other in this order from the front side to the rear side along the axis O. The front end portion 21 is a portion disposed on the front side in a direction of the axis O, and the outer circumferential surface of the front end portion 21 has a diameter that decreases toward the front side. The small-diameter portion 23 is a portion having an outer diameter that is larger than the outer diameter of the front end portion 21. A front end surface, of the small-diameter portion 23, on which a fitted portion 22 (see FIG. 2) is formed has a diameter that increases toward the rear side. A recessed portion 24 is formed in a section on the rear side of the outer circumferential surface of the small-diameter portion 23 so as to be recessed radially inward. The outer diameter of the large-diameter portion 25 is set to be substantially equal over the entire length thereof in the direction of the axis O. The outer diameter of the large-diameter portion 25 is larger than the outer diameter of the small-diameter portion 23.

A section on the rear side of the outer circumferential surface of the rear end portion 26 is corrugated. The outer diameter of the rear end portion 26 is smaller than the outer diameter of the large-diameter portion 25. In the insulator 20, an axial hole 27 is formed from the rear end portion 26 to the front end portion 21 along the direction of the axis O. A step portion 28 is formed at a section, of the axial hole 27, on the inner side of the small-diameter portion 23 such that the surface thereof faces the rear side.

The center electrode 40 is a rod-shaped member extending along the axis O, and is obtained by coating, with nickel or a nickel-based alloy, a core material made of copper or a core material containing copper as a main component. The center electrode 40 includes an axial portion 41, and a head portion 42 which is contiguous to the rear side of the axial portion 41 and which has a larger outer diameter than the axial portion 41. The head portion 42 of the center electrode 40 is fitted to the step portion 28 of the axial hole 27, and a front end of the axial portion 41 of the center electrode 40 is exposed from the axial hole 27.

The spark plug 10 includes a connection portion 43 which connects the center electrode 40 and the metal terminal 47 to each other in the axial hole 27. In the present embodiment, the connection portion 43 includes a first conductor 44, a resistor 45, and a second conductor 46.

The first conductor 44 is a conductive member for sealing and fixing the head portion 42 of the center electrode 40 in and to the insulator 20. The resistor 45 is a member for suppressing electric wave noise that is generated at the time of discharge, and the resistor 45 is disposed on the rear side relative to the first conductor 44 in the axial hole 27. The resistor 45 is electrically connected to the center electrode 40 by the first conductor 44 which is in contact with the center electrode 40 and the resistor 45.

The resistor 45 absorbs a component, of a discharge current, in a frequency band to which electric wave noise is attributed. Examples of the resistor 45 to be used include: an element (resistor) obtained by joining a film of a resistive material such as a carbon-based material, a metal, or a metal oxide to the surface of a base material such as ceramic; an element obtained by winding a resistance wire of Ni—Cr or the like around a base material such as ceramic; and a molded body of a mixture of an aggregate and a conductive powder.

Regarding the resistor obtained by mixing an aggregate and a conductive powder with each other and molding the resultant mixture, examples of the aggregate include a glass powder and an inorganic compound powder. Examples of the glass powder as the aggregate include powders of a $B_2O_3$—$SiO_2$-based material, a BaO—$B_2O_3$-based material, a $SiO_2$—$B_2O_3$—CaO—BaO-based material, a $SiO_2$—ZnO—$B_2O_3$-based material, a $SiO_2$—$B_2O_3$—$Li_2O$-based material, a $SiO_2$—$B_2O_3$—$Li_2O$—BaO-based material, and the like. Examples of the inorganic compound powder as the aggregate include powders of alumina, silicon nitride, mullite, steatite, and the like. Among these types of the aggregate, a single type may be used alone, or two or more types may be used in combination.

Examples of the conductive powder include powders of a semiconductive oxide, a metal, a non-metallic conductive material, and the like. Examples of the semiconductive oxide include $SnO_2$. Examples of the metal include Zn, Sb, Sn, Ag, and Ni. Examples of the non-metallic conductive material include amorphous carbon (carbon black), graphite, silicon carbide, titanium carbide, titanium nitride, tungsten carbide, and zirconium carbide. Among these types of the conductive powder, a single type may be used alone, or two or more types may be used in combination. In the present embodiment, the resistor 45 is obtained by molding, in the axial hole 27, a material powder which is a mixture of the aggregate and the conductive powder, and firing the resultant molded body in the axial hole 27.

The second conductor 46 is a member for electrically connecting the resistor 45 and the metal terminal 47 to each other. The first conductor 44 and the second conductor 46 are each obtained by firing a mixture of a glass powder and a conductive powder. As the glass powder and the conductive powder, a glass powder and a conductive powder similar to those used as the materials of the resistor are used. The first conductor 44 and the second conductor 46 may each contain, as necessary, a semiconductive inorganic compound powder of $TiO_2$ or the like, an insulative powder, etc.

The metal terminal 47 is a rod-shaped member to which a high-voltage cable (not shown) is connected, and is formed of a conductive metal material (e.g., low-carbon steel). The metal terminal 47 is fixed to a rear end of the insulator 20 in a state where a front side thereof is inserted in the axial hole 27. The metal terminal 47 is electrically connected to the center electrode 40 in the axial hole 27 via the first conductor 44, the resistor 45, and the second conductor 46.

The metal shell 50 is a substantially cylindrical member formed of a conductive metal material (e.g., low-carbon steel). The metal shell 50 includes: a trunk portion 51 surrounding the front end portion 21 and the small-diameter portion 23 of the insulator 20; a seat portion 55 contiguous to the rear side of the trunk portion 51; a coupling portion 56 contiguous to the rear side of the seat portion 55; a tool engagement portion 57 contiguous to the rear side of the coupling portion 56; and a rear end portion 58 contiguous to the rear side of the tool engagement portion 57.

The trunk portion 51 has an external thread 52 formed on the outer circumference thereof so as to be screwed into a thread hole of the internal combustion engine (not shown), and has a ledge portion 53 projecting radially inward. The small-diameter portion 23 of the insulator 20 is fitted to a rear end surface 54 (see FIG. 2) of the ledge portion 53 from the front side. The inner diameter of a section, of the trunk portion 51, which is located rearward of the ledge portion 53 is substantially equal over the entire length of the section in the direction of the axis O.

The seat portion 55 is a portion for closing a gap between the external thread 52 and the thread hole of the internal combustion engine (not shown), and is formed so as to have an outer diameter that is larger than the outer diameter of the trunk portion 51. The seat portion 55 surrounds a boundary between the small-diameter portion 23 and the large-diameter portion 25. The coupling portion 56 is a portion that is plastically deformed (bent) so that the metal shell 50 is crimped and fixed to the insulator 20 when the metal shell 50 is mounted on the insulator 20. The coupling portion 56 surrounds the outer circumference of the large-diameter portion 25.

The tool engagement portion 57 is a portion with which a tool such as a wrench is engaged when the external thread 52 is tightly screwed into the thread hole of the internal combustion engine (not shown). The tool engagement portion 57 surrounds the rear side of the large-diameter portion 25 and the rear end portion 26 of the insulator 20. The rear end portion 58 is bent radially inward, and is positioned rearward of the large-diameter portion 25.

A filler 59 such as talc is disposed at a portion that is on a radially inner side of the tool engagement portion 57 and the rear end portion 58 and that is located frontward of the rear end portion 58 but rearward of the large-diameter portion 25. The metal shell 50 holds the insulator 20 with the small-diameter portion 23 and the large-diameter portion 25 of the insulator 20 being inserted therein in the direction of the axis O, via the filler 59. The ground electrode 60 is a rod-shaped member made of a metal (e.g., a nickel-based alloy) and joined to the metal shell 50. A front end of the ground electrode 60 is opposed to the center electrode 40 with a space (spark gap) interposed therebetween.

Figure 2:
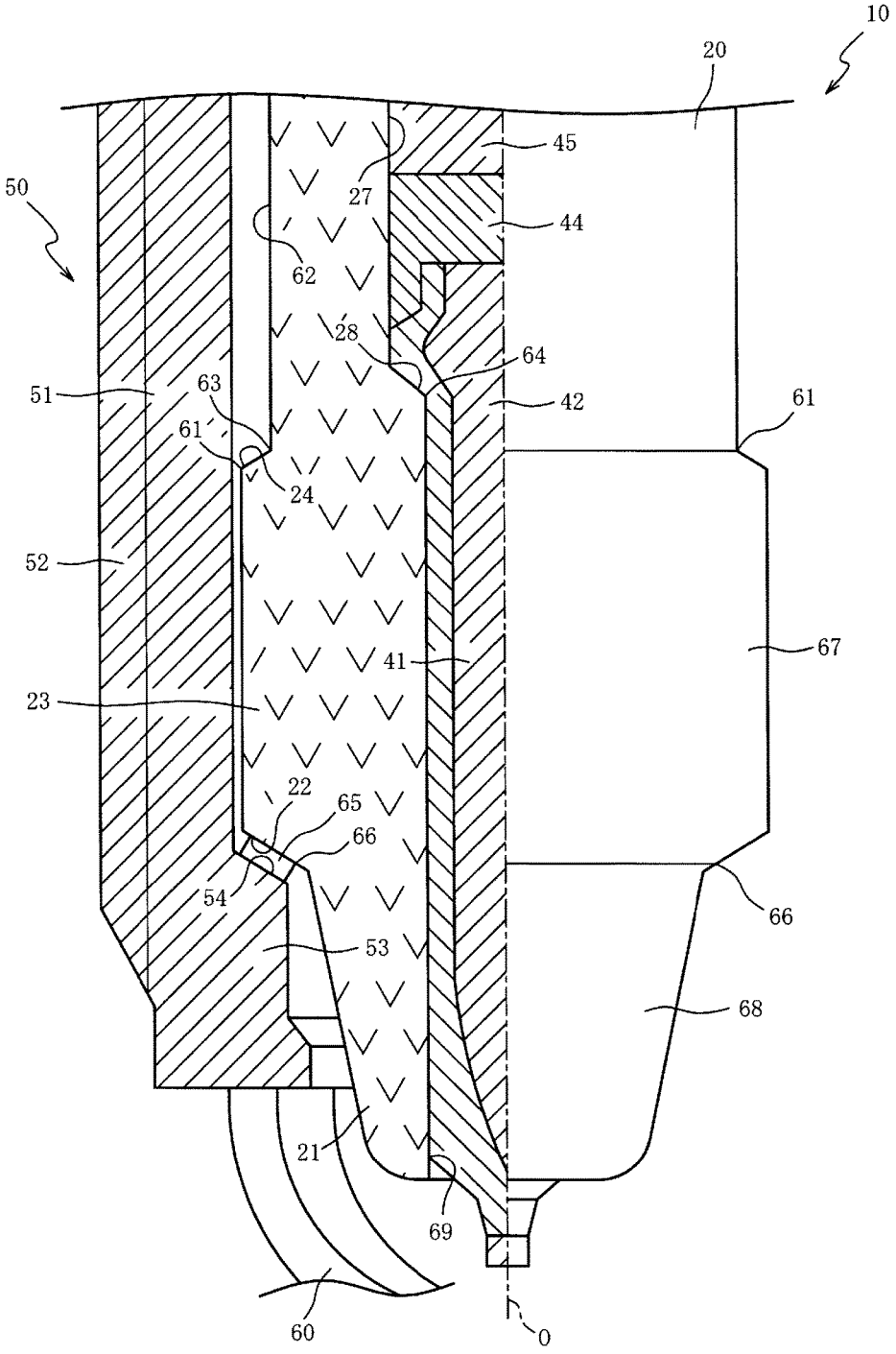
FIG. 2 is an enlarged half-sectional view of a front side of the spark plug.

FIG. 2 is an enlarged half-sectional view of the front side of the spark plug 10, with the axis O as the boundary. FIG. 2 shows half of a full-sectional view of the spark plug 10 and half of an external appearance of the insulator 20 (the same applies to FIG. 3). From a front end 61 of the recessed portion 24 positioned on the radially outer side of the center electrode 40 to the large-diameter portion 25 (see FIG. 1), the recessed portion 24 is formed over the entire circumference of the outer circumferential surface of the small-diameter portion 23. The outer diameter of a bottom portion 62 on the radially inner side of the recessed portion 24 is substantially equal over the entire length of the bottom portion 62 in the direction of the axis O. A gap between the bottom portion 62 and the inner circumferential surface of the trunk portion 51 of the metal shell 50 is larger than 0.1 mm.

A front end 63 of the bottom portion 62 is positioned on the rear side in the direction of the axis O relative to the front end 61 of the recessed portion 24. The recessed portion 24 has a diameter that increases, toward the front side, from the front end 63 of the bottom portion 62 to the front end 61 of the recessed portion 24. In the step portion 28 to which the head portion 42 of the center electrode 40 is fitted, a front end 64 of a section, of the step portion 28, which is in contact with the center electrode 40 (head portion 42) is positioned rearward (upper side in FIG. 2) of the front end 63 of the bottom portion 62. In the present embodiment, the front end 64 is positioned at an edge (front end portion) of the step portion 28.

A packing 65 is interposed between the rear end surface 54 of the ledge portion 53 of the metal shell 50 and the small-diameter portion 23 of the insulator 20. The packing 65 is an annular sheet member formed of a metal material such as a soft steel sheet that is softer than the metal material of which the metal shell 50 is formed. The small-diameter portion 23 includes a fitted portion 22 which is fitted to the ledge portion 53 via the packing 65. The fitted portion 22 is a portion, of the front end surface of the small-diameter portion 23, with which the packing 65 is in contact. The fitted portion 22 of the insulator 20 is in indirect contact with the rear end surface 54 of the ledge portion 53 via the packing 65.

The spark plug 10 is manufactured by, for example, the following method. First, the center electrode 40 is inserted in the axial hole 27 of the insulator 20, and the head portion 42 of the center electrode 40 is fitted to the step portion 28. Then, a material powder of the first conductor 44 is put in the axial hole 27 so as to be filled around the head portion 42. A compression bar member (not shown) is used in order to perform preliminary compression of the material powder filled in the axial hole 27. Next, a material powder of the resistor 45 is put in the axial hole 27 so as to be filled rearward of the material powder of the first conductor 44. The compression bar member (not shown) is used in order to perform preliminary compression of the material powder filled in the axial hole 27. Then, a material powder of the second conductor 46 (see FIG. 1) is put in the axial hole 27 so as to be filled rearward of the resistor 45. The compression bar member (not shown) is used in order to perform preliminary compression of the material powder filled in the axial hole 27.

Then, the insulator 20 is transferred into a furnace, and is heated to, for example, a temperature higher than a softening point of a glass component contained in the material powders. After the material powders are softened, the softened material powders are compressed in the direction of the axis O by the metal terminal 47 inserted in the axial hole 27 of the insulator 20. As a result, the material powders are compressed and sintered, and the first conductor 44, the resistor 45, and the second conductor 46 are formed in the axial hole 27.

Next, the insulator 20 is inserted in the metal shell 50 to which the ground electrode 60 is joined in advance, and the coupling portion 56 and the rear end portion 58 are bent so that the metal shell 50 is mounted on the insulator 20. The ground electrode 60 is bent such that the front end of the ground electrode 60 is opposed to the center electrode 40, thereby obtaining the spark plug 10.

The spark plug 10 is used in a state where the external thread 52 of the metal shell 50 is mounted in the thread hole of the internal combustion engine (not shown). In the spark plug 10, since the insulator 20 is interposed between the metal shell 50, and the center electrode 40 and the connection portion 43 (see FIG. 1), parasitic capacitance is present between the metal shell 50, and the center electrode 40 and the connection portion 43. When high voltage is applied between the metal terminal 47 and the metal shell 50, charges are stored by the parasitic capacitance. The stored charges move at the time of discharge, resulting in increase in erosion (electrode erosion) of the center electrode 40 and the ground electrode 60.

Here, at the time of discharge, charges stored between the resistor 45 and the metal shell 50 among the charges stored by the parasitic capacitance move from the resistor 45 via the first conductor 44 to the center electrode 40, and thus, voltage drop occurs when the charges pass through the resistor 45. Since the energy of the charges can be reduced accordingly, electrode erosion can be made less likely to occur. Therefore, in order to suppress electrode erosion due to parasitic capacitance, it is effective to reduce parasitic capacitance that is present between the metal shell 50, and sections located frontward of the resistor 45, i.e., the first conductor 44 and the center electrode 40.

In order to reduce the parasitic capacitance that is present between the metal shell 50, and the first conductor 44 and the center electrode 40, means of reducing the volume (particularly, the length in the axial direction) of the first conductor 44, and means of reducing the inner diameter of the axial hole 27 (increasing the thickness of the small-diameter portion 23), are available.

However, if the volume of the first conductor 44 is reduced, the area of contact between the first conductor 44 and the center electrode 40 (head portion 42) is reduced, and thus, there is a risk that the contact between the first conductor 44 and the center electrode 40 comes to be unstable (impact resistance is reduced) owing to impact or vibration. In addition, if the volume of the first conductor 44 is reduced, there is a risk that the center electrode 40 (head portion 42) comes into contact with the resistor 45, resulting in variation in a resistance value. Furthermore, if the inner diameter of the axial hole 27 is reduced in order to increase the thickness of the small-diameter portion 23, also the outer diameter of the resistor 45 is reduced, and thus, there is a risk that the life span of the resistor 45 is shortened.

Therefore, in the spark plug 10, the recessed portion 24 is formed in the outer circumferential surface of the small-diameter portion 23 (insulator 20), with the position of the recessed portion 24 being set on the radially outer side of the first conductor 44 and the head portion 42 of the center electrode 40. Thus, the insulator 20 (small-diameter portion 23) and the recessed portion 24 (air layer) are interposed between the metal shell 50, and the first conductor 44 and the head portion 42 of the center electrode 40. The dielectric constant of the air layer is less than the dielectric constant of the insulator 20, and thus, as compared with a case where the recessed portion 24 is not formed, the parasitic capacitance between the metal shell 50, and the first conductor 44 and the head portion 42 of the center electrode 40, can be reduced. Since the charges that are stored between the metal shell 50, and the first conductor 44 and the head portion 42 of the center electrode 40, can be reduced, electrode erosion can be made less likely to occur.

Furthermore, in the spark plug 10, the area of an outer circumferential surface 67, of the insulator 20, from the front end 61 of the recessed portion 24 to a front end 66 of the fitted portion 22 (a portion with which the packing 65 is in contact) is set to be larger than or equal to the area of a surface 68, of the insulator 20, which is exposed to combustion gas from the internal combustion engine (not shown). A gap between the small-diameter portion 23 of the outer circumferential surface 67 and the inner circumferential surface of the trunk portion 51 of the metal shell 50 is set to be not larger than 0.1 mm.

The surface 68, of the insulator 20, which is exposed to combustion gas is a combination of: an outer surface, of the insulator 20, which is located frontward (lower side in FIG. 2) of the front end 66 of the fitted portion 22; and an inner surface, of the insulator 20, which is located frontward of a frontmost-side position 69 among positions at each of which the gap between the axial hole 27 of the insulator 20 and the axial portion 41 (center electrode 40) is not larger than 0.1 mm.

The surface 68 of the insulator 20 is exposed to combustion gas, and thus, receives heat primarily from the internal combustion engine (not shown). The outer circumferential surface 67, of the insulator 20, from the front end 61 of the recessed portion 24 to the front end 66 of the fitted portion 22, contributes to heat dissipation from the insulator 20 to the metal shell 50. The fitted portion 22 of the outer circumferential surface 67 transmits heat to the metal shell 50 through thermal conduction by the packing 65. A section, of the outer circumferential surface 67, other than the fitted portion 22 transmits heat to the metal shell 50 through convection and radiation of a gap (air) between the small-diameter portion 23 and the metal shell 50. Since the area of the outer circumferential surface 67 is set to be larger than or equal to the area of the surface 68, heat dissipation from the outer circumferential surface 67 of the insulator 20 to the trunk portion 51 can be facilitated. Therefore, the heat dissipation property from the insulator 20 to the metal shell 50 can be improved. As a result, it is possible to inhibit, for example, degradation of the center electrode 40 and occurrence of pre-ignition, due to overheating of the insulator 20.

In addition, in the step portion 28 to which the head portion 42 of the center electrode 40 is fitted, the front end 64 of the section, of the step portion 28, which is in contact with the center electrode 40 (head portion 42) is positioned rearward of the front end 63 of the bottom portion 62, and thus, thermal stress received from the internal combustion engine (not shown) can be made less likely to be transmitted to the first conductor 44 and the resistor 45. Therefore, degradation of the first conductor 44 and the resistor 45 due to overheating thereof can be suppressed.

Figure 3:
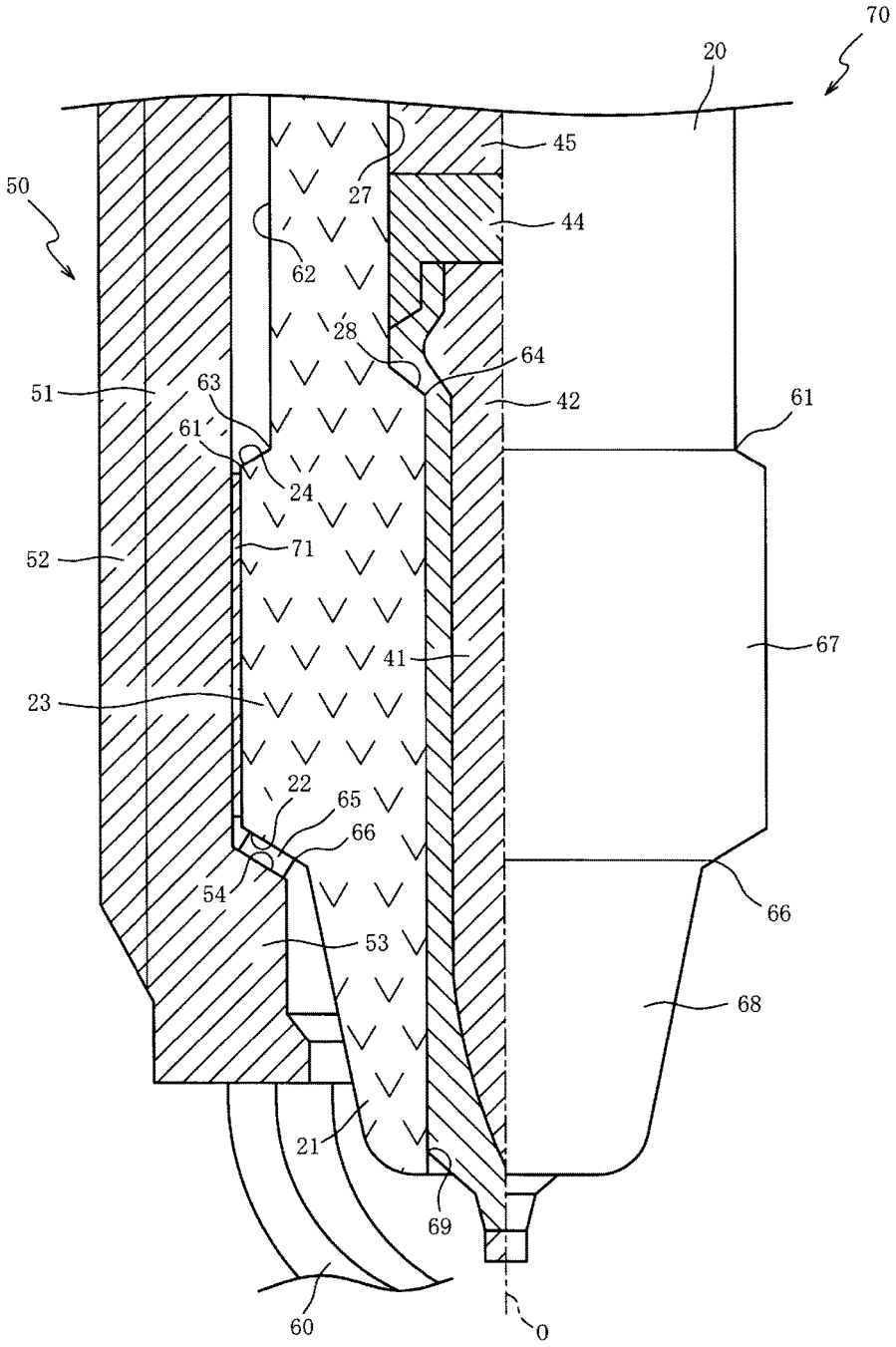
FIG. 3 is a half-sectional view of a spark plug according to a second embodiment.

A second embodiment will be described with reference to FIG. 3. In the first embodiment, a case has been described where the air layer (gap) is interposed between the metal shell 50 and the outer circumferential surface 67 (other than the fitted portion 22) of the insulator 20. On the other hand, in the second embodiment, a spark plug 70 will be described in which a filler 71 is interposed between the metal shell 50 and the outer circumferential surface 67 (other than the fitted portion 22) of the insulator 20. The same components as described in the first embodiment will be denoted by the same reference numerals, and the description thereof is omitted. FIG. 3 is a half-sectional view of the spark plug 70 according to the second embodiment.

In the spark plug 70, the filler 71 is filled between the metal shell 50 and a part of a section (outer circumferential surface 67), of the outer circumferential surface of the insulator 20, from the front end 66 of the fitted portion 22 to the front end 61 of the recessed portion 24. The filler 71 is a heat resistant member and is in close contact with parts of the outer circumferential surface 67 and the metal shell 50. As the filler 71, for example, an inorganic adhesive (so-called cement), or a composition that contains glass particles of a $B_2O_3$—$SiO_2$-based material or the like, is used.

Since the filler 71 is interposed between the metal shell 50 and the outer circumferential surface 67 of the insulator 20, heat can be transmitted from the insulator 20 via the filler 71 to the metal shell 50 through thermal conduction. Therefore, the heat dissipation property of the insulator 20 can be further improved.

EXAMPLES

The present invention will be more specifically described according to examples. However, the present invention is not limited to the examples.

On the basis of the spark plug 10 according to the first embodiment, an examiner prepared various samples 1 to 10 which were different in terms of the ratio of the area of the outer circumferential surface 67 of the insulator 20 to the area of the surface 68, of the insulator 20, to be exposed to combustion gas. The examiner prepared the samples such that the samples are equal in terms of the area of the surface 68 to be exposed to combustion gas, but are different in terms of the length in the direction of the axis O of a surface of a section, other than the fitted portion 22, of the outer circumferential surface 67, and thus, are different in terms of the ratio of the area of the outer circumferential surface 67 to the area of the surface 68. The recessed portion 24 was formed in the outer circumferential surface of the insulator 20 (small-diameter portion 23) of each sample so as to have a depth of 0.8 mm. The gap between the metal shell 50 and a section, of the outer circumferential surface 67, other than the recessed portion 24 and the fitted portion 22 was not larger than 0.1 mm.

The examiner mounted each sample to a sheet member made of an aluminum alloy and having the thread hole which penetrated therethrough and into which the external thread 52 of the metal shell 50 was screwed. The examiner heated the front end portion 21 of the insulator 20 for 50 hours with use of a burner such that the temperature of the front end of the center electrode 40 reached 950° C. The temperature of the center electrode 40 was measured with use of a radiation thermometer. During a test in which the sample was heated with use of the burner, the sheet member having the sample mounted thereto was cooled such that the temperature of the sheet member was 80° C. Therefore, during the test, the metal shell 50 of each sample was cooled via the sheet member.

After the test, the center electrode 40 was observed with use of a microscope, and whether or not the center electrode 40 had any crack was checked. The samples each having no crack in the center electrode 40 were determined to be "good (G)", and the samples each having a crack in the center electrode 40 were determined to be "not good (NG)". The area of the outer circumferential surface 67 with the area of the surface 68 of each sample being 100 (the ratio of the area of the outer circumferential surface 67 to the area of the surface 68), and the corresponding result are shown in Table 1.

TABLE 1

| | Area | Determination |
|---|---|---|
| 1 | 50 | NG |
| 2 | 70 | NG |
| 3 | 90 | NG |
| 4 | 100 | G |
| 5 | 110 | G |
| 6 | 130 | G |
| 7 | 150 | G |
| 8 | 170 | G |
| 9 | 190 | G |
| 10 | 200 | G |

As shown in Table 1, the samples 1 to 3 in each of which the area of the outer circumferential surface 67 was smaller than the area of the surface 68 were NG, whereas the sample 4 in which the area of the surface 68 and the area of the outer circumferential surface 67 were equal, and the samples 5 to 10 in each of which the area of the outer circumferential surface 67 was larger than the area of the surface 68, were G. It is inferred that, in each of the samples 1 to 3 in which the area of the outer circumferential surface 67 was smaller than the area of the surface 68, heat was difficult to be transmitted from the insulator 20 to the metal shell 50, and thus, the insulator 20 and the center electrode 40 were overheated, resulting in a crack in the center electrode 40.

On the other hand, it is inferred that, in each of the sample 4 in which the area of the surface 68 and the area of the outer circumferential surface 67 were equal and the samples 5 to 10 in each of which the area of the outer circumferential surface 67 was larger than the area of the surface 68, heat was sufficiently transmitted from the insulator 20 to the metal shell 50, and thus, the insulator 20 and the center electrode 40 were able to be prevented from being overheated, resulting in no crack in the center electrode 40. According to these examples, it has been clarified that, by setting the area of the outer circumferential surface 67 to be larger than or equal to the area of the surface 68, the heat dissipation property from the insulator 20 to the metal shell 50 can be improved.

Although the present invention has been described based on the embodiments, the present invention is not limited to the above-described embodiments at all. It can be easily understood that various modifications can be devised without departing from the gist of the present invention.

In each embodiment, a case has been described where the resistor 45 is disposed in the axial hole 27 of the insulator 20, but the present invention is not necessarily limited thereto. As a matter of course, the resistor 45 and the second conductor 46 may be omitted. In a case where the resistor 45 and the second conductor 46 are omitted, a portion, of the metal terminal 47, which is inserted in the axial hole 27 is elongated in the direction of the axis O, and the center electrode 40 and the metal terminal 47 are connected to each other by the first conductor 44.

Even in the case where the resistor 45 and the second conductor 46 are omitted, the parasitic capacitance between the metal shell 50, and the first conductor 44 and the head portion 42 of the center electrode 40, can be reduced owing to the recessed portion 24 (air layer). Since charges that are stored between the metal shell 50, and the first conductor 44 and the head portion 42 of the center electrode 40, can be reduced, electrode erosion due to charges flowing into the spark gap at the time of discharge can be made less likely to occur.

In each embodiment, a case has been described where the resistor 45 obtained by molding the material powders in the axial hole 27 and firing the resultant molded body in the axial hole 27 is used, but the present invention is not necessarily limited thereto. As a matter of course, a resistor (element) may be used as the resistor 45. In this case, as a matter of course, insulative glass may be interposed between the resistor 45 and the insulator 20 so as not to damage the resistor 45 owing to vibration.

In each embodiment, a case has been described where the resistor 45 is connected to the metal terminal 47 by the second conductor 46 made of conductive glass, but the present invention is not necessarily limited thereto. As a matter of course, for example, instead of the conductive glass, the resistor 45 and the metal terminal 47 may be electrically connected to each other by interposing an elastic body (second conductor) such as a conductive spring between the resistor 45 and the metal terminal 47.

In each embodiment, a case has been described where the packing 65 is interposed between the insulator 20 and the rear end surface 54 of the ledge portion 53 of the metal shell 50, but the present invention is not necessarily limited thereto. As a matter of course, the insulator 20 and the rear end surface 54 of the ledge portion 53 of the metal shell 50 may be brought into close contact with each other, with the packing 65 being omitted. In this case, the front end 66 of the fitted portion 22 is a front end of a section, of the insulator 20, with which the rear end surface 54 of the ledge portion 53 is in contact.

In each embodiment, a case has been described where the front end 64 of the section, of the step portion 28, which is in contact with the center electrode 40 (head portion 42) is positioned at the edge of the step portion 28, but the present invention is not necessarily limited thereto. The position of the front end 64 is appropriately set in accordance with the shape of the head portion 42 of the center electrode 40. For example, in a case where the head portion 42 has such a shape that the head portion 42 does not come into contact with the edge (front end portion) of the step portion 28, the front end 64 is set within the surface of the step portion 28.

In each embodiment, a case has been described where the center electrode 40 obtained by coating, with nickel or a nickel-based alloy, the core material made of copper or the core material containing copper as a main component, is used, but the present invention is not necessarily limited thereto. As a matter of course, a center electrode 40 in which the core material made of copper, etc., is omitted may be used.

In each embodiment, a case has been described where the ground electrode 60 joined to the metal shell 50 is bent. However, the present invention is not necessarily limited thereto. As a matter of course, instead of using the bent ground electrode 60, a linear ground electrode 60 may be used. In this case, the front side of the metal shell 50 is elongated in the direction of the axis O, and the linear ground electrode 60 is joined to the metal shell 50 so that a front end of the ground electrode 60 is opposed to the center electrode 40.

In each embodiment, a case has been described where the ground electrode 60 is disposed such that the front end of the ground electrode 60 and the center electrode 40 are opposed to each other on the axis O. However, the present invention is not necessarily limited thereto, and the positional relationship between the ground electrode 60 and the center electrode 40 may be appropriately set. Examples of another positional relationship between the ground electrode 60 and the center electrode 40 include a positional relationship in which the ground electrode 60 is disposed such that a side surface of the center electrode 40 and the front end of the ground electrode 60 are opposed to each other.

In each embodiment, a case has been described where one ground electrode 60 is joined to the metal shell 50, but the present invention is not necessarily limited thereto. As a matter of course, a plurality of the ground electrodes 60 may be joined to the metal shell 50.

DESCRIPTION OF REFERENCE NUMERALS

10, 70: spark plug
20: insulator
22: fitted portion
24: recessed portion
27: axial hole
28: step portion
40: center electrode
43: connection portion
44: first conductor
45: resistor
46: second conductor
47: metal terminal
50: metal shell
53: ledge portion
54: rear end surface of ledge portion
61: front end of recessed portion
62: bottom portion
63: front end of bottom portion
64: front end of section which is in contact with center electrode
66: front end of fitted portion
67: outer circumferential surface
68: surface which is exposed to combustion gas
71: filler
O: axis Having described the invention, the following is claimed:

1. A spark plug comprising:

an insulator in which an axial hole is formed so as to extend in a direction of an axis from a front side to a rear side;

a center electrode at least partially inserted in a front side of the axial hole;

a metal terminal at least partially inserted in a rear side of the axial hole;

a connection portion connecting the metal terminal and the center electrode to each other in the axial hole; and a tubular metal shell disposed on an outer circumference of the insulator, the metal shell including a ledge portion which projects from an inner circumference side thereof, and the insulator including a fitted portion in contact with a rear end surface of the ledge portion, and having a recessed portion recessed radially inward, the recessed portion being formed in an outer circumferential surface which is located on the rear side of the insulator relative to the fitted portion and which is disposed in the metal shell, wherein, in the insulator, an area of an outer circumferential surface from a front end of the recessed portion to a front end of the fitted portion is larger than or equal to an area of a surface which is exposed to combustion gas.

2. The spark plug according to claim 1, wherein the connection portion includes a first conductor in contact with the center electrode, a resistor in contact with the first conductor, and a second conductor in contact with the resistor and the metal terminal, the insulator has a step portion to which the center electrode is fitted from the front side in the axial hole, and a front end of a section, of the step portion, which is in contact with the center electrode is positioned rearward of a front end of a bottom portion on a radially inner side of the recessed portion.

3. The spark plug according to claim 1, wherein a filler is filled between the metal shell and at least a part of a section, of the outer circumferential surface of the insulator, from the front end of the fitted portion to the front end of the recessed portion.

4. The spark plug according to claim 2, wherein a filler is filled between the metal shell and at least a part of a section, of the outer circumferential surface of the insulator, from the front end of the fitted portion to the front end of the recessed portion.

* * * * *